United States Patent [19]

Southard

[11] Patent Number: 4,525,634

[45] Date of Patent: Jun. 25, 1985

[54] ALTERNATING CURRENT SWITCHING DEVICE

[76] Inventor: James S. Southard, P.O. Box 46, Union, Mich. 49130

[21] Appl. No.: 493,225

[22] Filed: May 10, 1983

[51] Int. Cl.[3] ..... H01H 47/00

[52] U.S. Cl. ..... 307/115; 307/140; 315/361; 315/363; 361/169.1; 340/815.23

[58] Field of Search ..... 307/113, 114, 115, 140, 307/252 UA; 361/168.1, 169.1, 186; 340/815.23; 315/361, 362

[56] References Cited

U.S. PATENT DOCUMENTS 4,011,482 3/1977 Seib ..... 307/115 X
4,019,150 4/1977 Barrus ..... 361/186

FOREIGN PATENT DOCUMENTS 2753765 7/1978 Fed. Rep. of Germany ..... 361/186

OTHER PUBLICATIONS

Earl Savage, "Light-Puzzle Solution and More" Hobby Corner of *Radio-Electronics,* pp. 80-81, Mar. 1983.

*Primary Examiner*—A. D. Pellinen
*Assistant Examiner*—Derek S. Jennings
*Attorney, Agent, or Firm*—Kenyon & Kenyon

[57] ABSTRACT

A switching circuit provides multi-way control of the connection of a relatively high current load to a source of power by the momentary closing of any one of a number of switches at remote locations. A control current in the milliampere range is fed to the remote switches at a voltage having either one of two levels, depending on whether the load is connected or not. An indicator which is sensitive to the voltage levels at each remote location shows the on/off status of the load connection.

13 Claims, 5 Drawing Figures

Fig. 2.
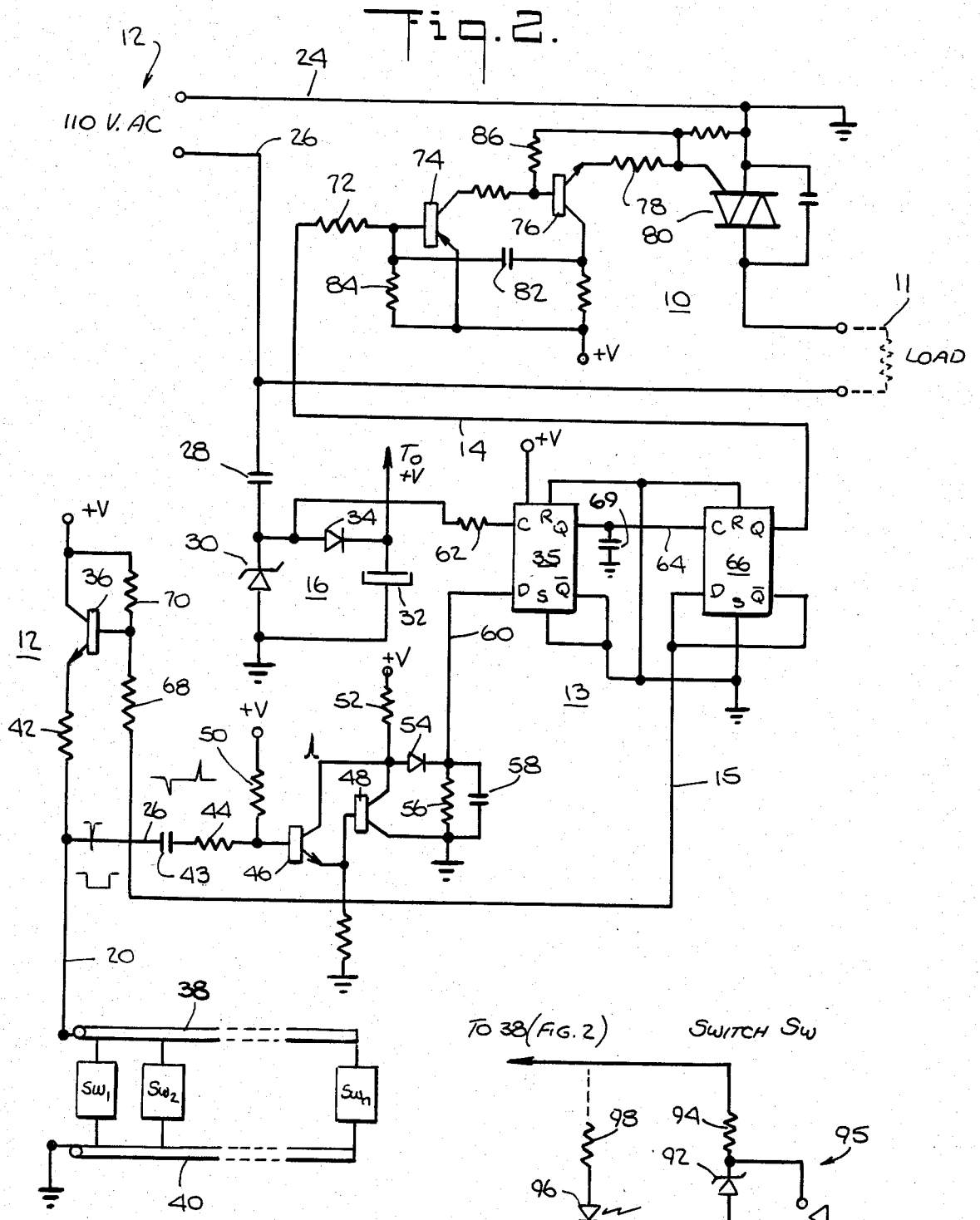
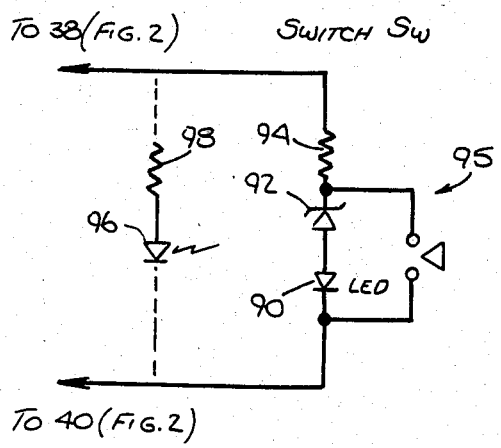
Fig. 3.

ALTERNATING CURRENT SWITCHING DEVICE

BACKGROUND OF THE INVENTION

This invention relates to switching arrangements for controlling the flow of a relatively high current to a load at a remote location by means of a control circuit using low level current. More particularly, it relates to a control circuit to which a number of control switches can be connected to control switching of current to the load independently of each other and in which provision is made to indicate the on/off status of the load.

Using present day house wiring techniques, the operation of a current consuming device at a fixed location, such as a lamp for illuminating a stairway, can be controlled from two or more switches placed at locations which may be remote from the current consuming device. A typical stairway lighting circuit has two single-pole double-throw switches which are located at the top and bottom of the stairs. The switches which are interconnected by standard electric wiring so that the current flowing to the stairway lights can be directed to the lamp via one or the other of two control wires. (The return flow of current from the lamp does not go through through the switches). In this arrangement, the flow of current is directed to the pole of one switch and travels, depending upon the position of the pole, via either one of the two wires to the second switch. At the second switch, either of the two wires can be connected by the switch pole to the load. When both switches are connected to the same control wire, current flows though the switches to the load. By switching either of the two switches into connection with the other lead, current flow will cease, but can be reestablished at either switch. So called three-way or multi-way systems of the type just described require the use of multiple switches and wiriing which must be able to handle the full load current and voltages.

It is an object of the present invention to provide a multi-way switch system which is capable of operation from a multiplicity of locations and which permits the use of control circuitry operating at low current and voltages.

It is another object of the invention to provide a multi-way control system which is capable of reporting the on-off status of the load device at any or all of the remote control locations.

It is an additional object of the invention to provide a multi-way switch system in which the wiring is simplified so that only two control conductors are required to connect one or a plurality of switch circuits for control of the same load circuit and which, at the same time, affords status reports as aforesaid.

SUMMARY OF THE INVENTION

The above objects, and others which will become apparent from the following specification, are met by the present invention in which a bistable load switch responds to successive control signals, any one of which may be supplied by any of a number of control switches which are placed at remote locations, to make and break connection of a load to a source of electric power. A pair of electric conductors extends from the location of the load switch to each control switch location. The control circuit is supplied with voltage from a current supply and conducts each control signal originating at a control switch to control the load switch. Each control switch when open, presents a normal impedance to the control circuit and when actuated, provides a control signal in the form of a momentary change of impedance. The control circuit is supplied with voltage from a current supply and the momentary closing of a control switch results in a momentary increase in current flow from the current supply through the control circuit and the switch. A signal voltage is derived from the momentary change in current flow and is fed to the load control switch to connect or disconnect the load to the power source. At the same time, the level of voltage supplied to the control circuit by the current supply is changed so that one voltage level is present when the load is connected to the power source, and another voltage level is present when the load is disconnected. This change in voltage level on the control circuit constitutes, in effect, an indicator signal. A voltage sensitive indicator is connected to the control circuit along with each control switch and responds to one of the voltage levels present on the control circuit to show a predetermined condition of the load control switch, such as an on condition. Since this indicator does not respond to the other voltage level, it also shows when the load control switch is off. A second indicator which responds to both voltage levels can be provided at each remote location to show that the control system is energized.

BRIEF DESCRIPTION OF THE DRAWINGS

FIG. 2 is a circuit diagram showing details of a circuit implementing the block diagram of FIG. 1;

FIG. 3 is a circuit diagram of a remote control switch unit for use with the system of FIGS. 1 and 2.

DETAILED DESCRIPTION OF THE INVENTION

The same reference numbers are used throughout the several figures to denote the same or similar components.

Figure 1:
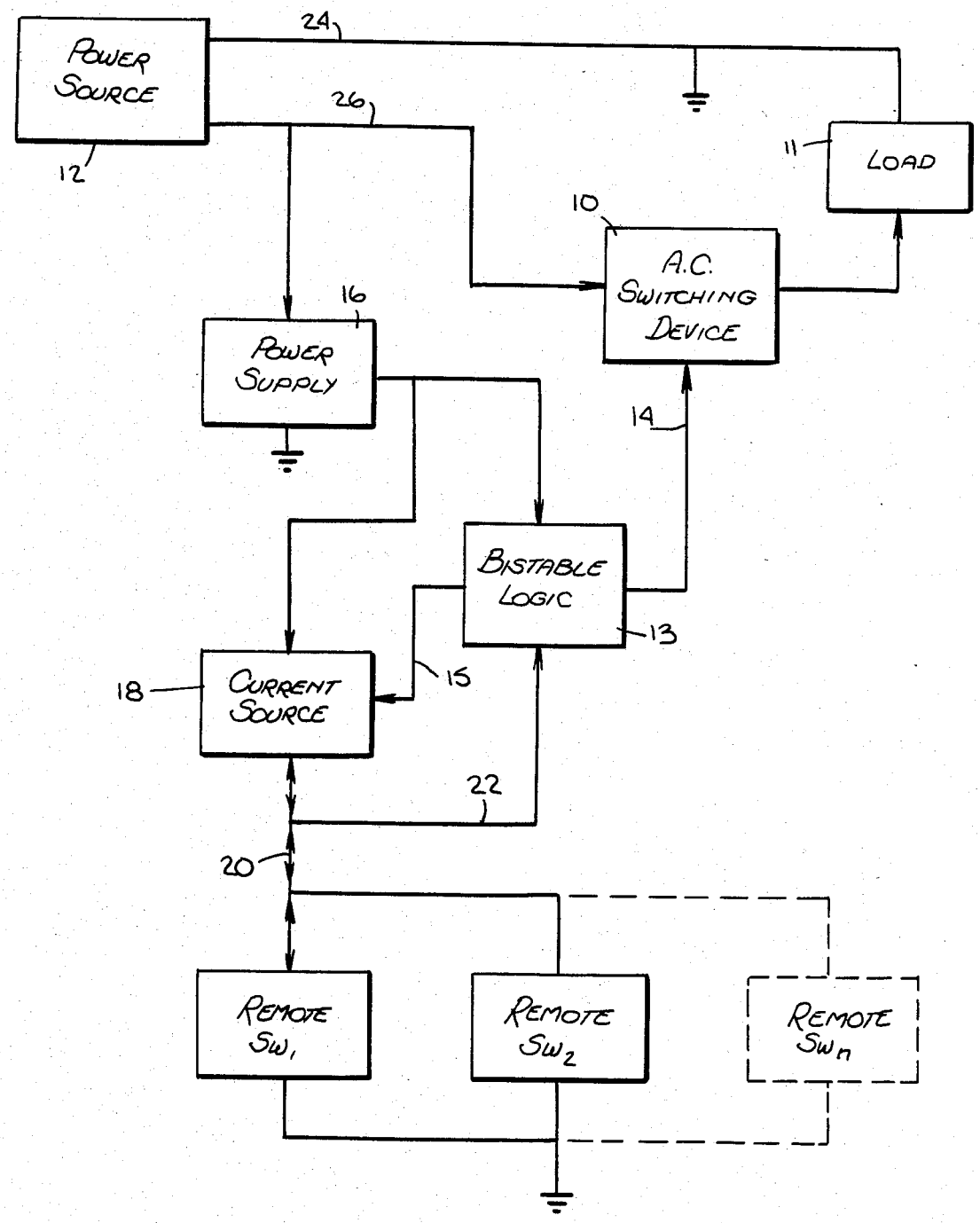
FIG. 1 is a block diagram which illustrates a switching system according to the invention.

FIG. 1 is a simplified block diagram of an electronic switching system for the remote control of a load from a plurality of locations in accordance with the teachins of the invention. In FIG. 1, switching device 10 controls the connection of power source 12 to load 11, which may be a motor, lamp, or the like. Switching device 10 is, in turn, controlled by means of a control signal which is fed to it on lead 14 from bistable logic circuit 13. Power source 12 also feeds power supply 16 which produces low voltage DC for operating logic circuit 13 and for current supply 18. Current supply 18 feeds voltage at one of two levels to remote switch units $SW_1$, $SW_2$, . . . $SW_n$ via control conductor 20. Current supply 18 responds to a control signal received on line 15 from bistable logic circuit 13 to provide one or the other of two voltage levels, depending on the condition of the load control switch. Logic circuit 13 senses and responds to a signal from any of remote switches $SW_1$, $SW_2$ . . . $SW_n$ to control both switching device 10 and the level of the voltage supplied by current supply 18. Each remote switch unit has a voltage level sensitive indicator (shown in FIG. 3) which responds to one of the two voltage levels to indicate that the load is connected. A second indicator (FIG. 3), which responds to either voltage level, may be included with each control switch to show that the control system is energized.

Figure 1A:
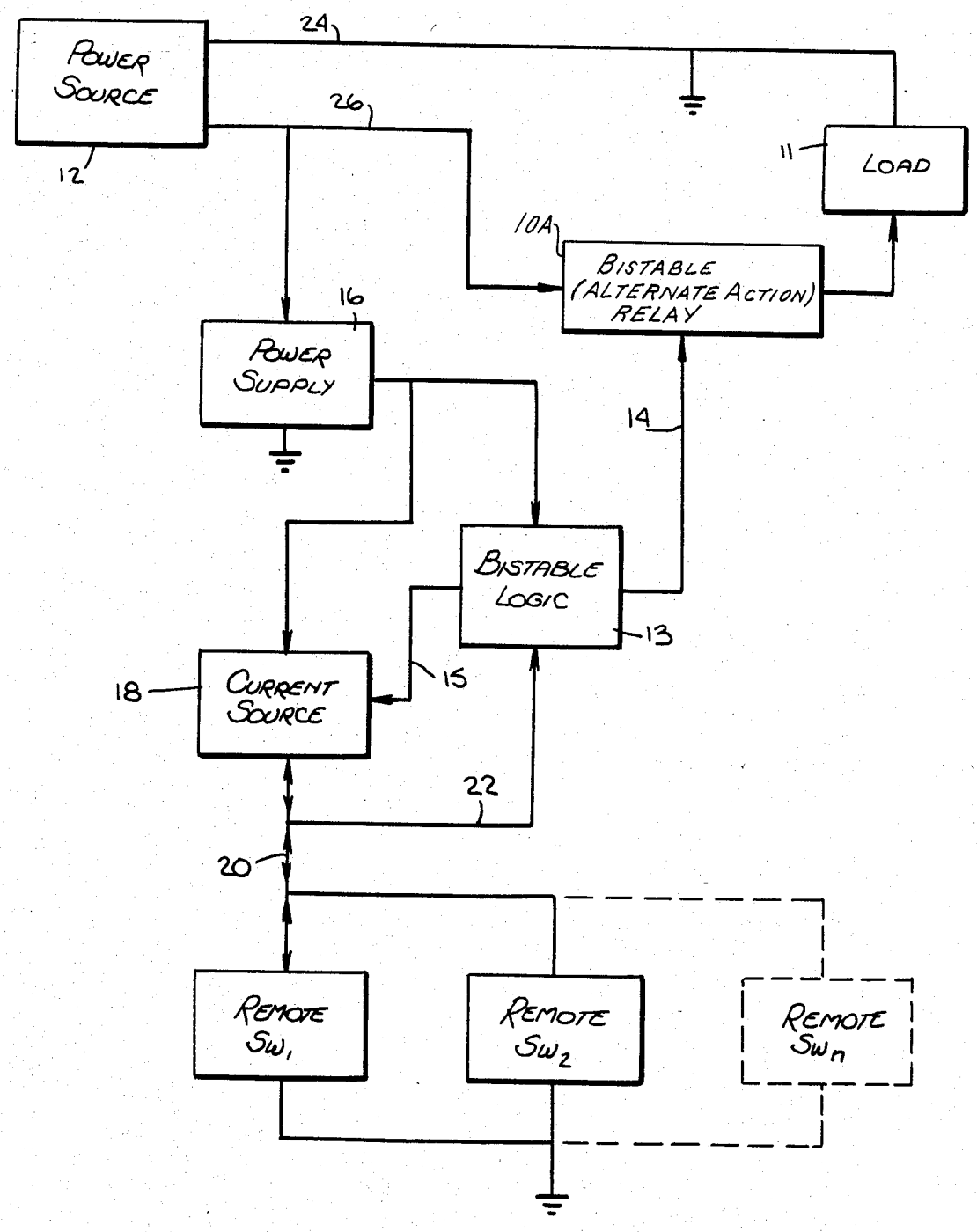
FIG. 1A is a block diagram similar to that of FIG. 1 illustrating a switching system according to the invention which includes an alternate action relay.

In FIG. 1A, an AC switching device is embodied by an alternate action relay 10A.

Figure 4:
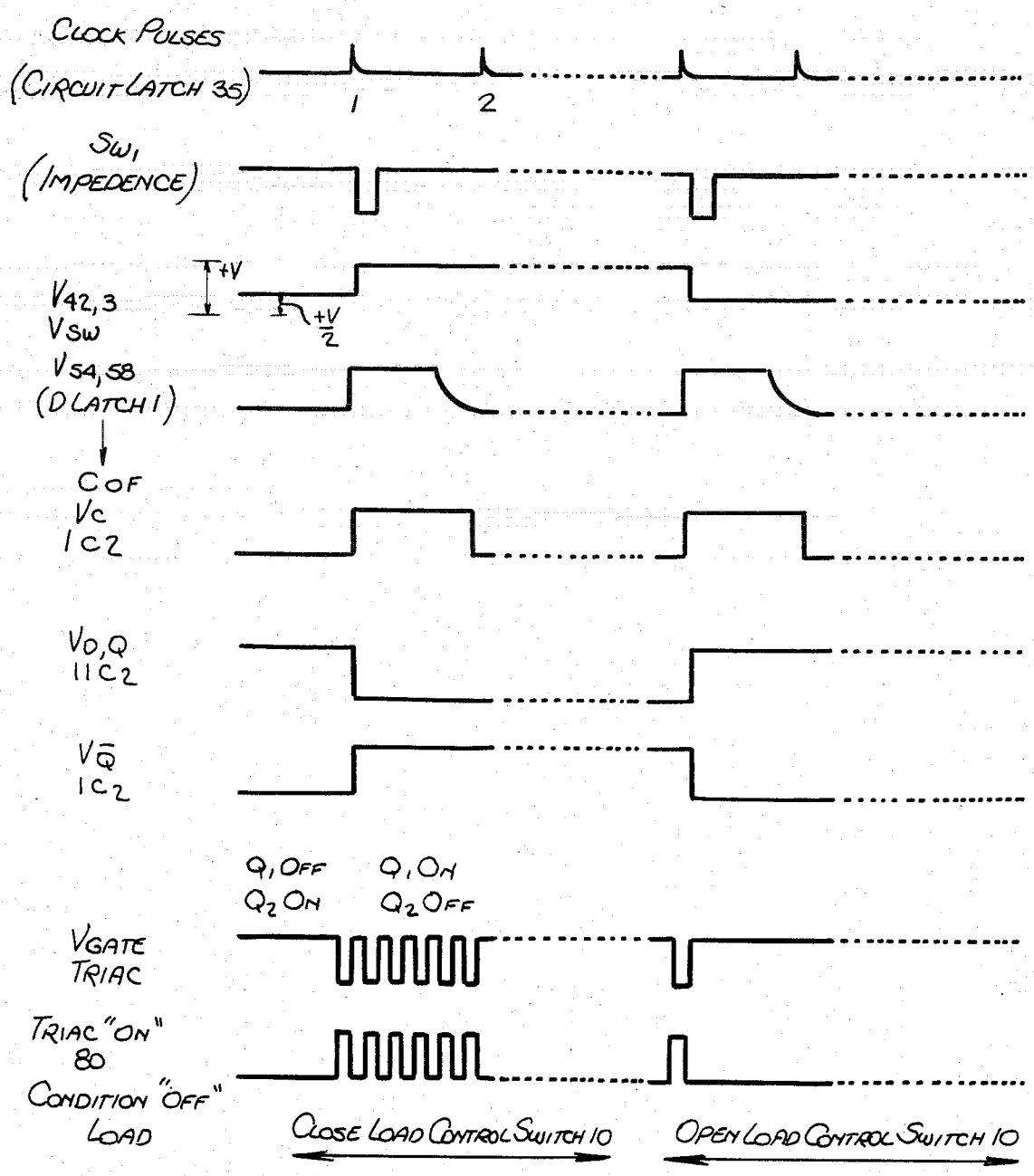
FIG. 4 is a timing diagram showing voltages at various points during operation of the circuit of FIG. 2.

FIG. 2 is schematic diagram of a circuit which implements the block diagram of FIG. 1 and FIG. 3 shows the circuit of an embodiment of a control switch in accordance with the invention. Reference to the timing charts of FIG. 4 will assist in understanding the operation of the circuit.

In FIG. 2, power source 12, which may be a 110 volt, 60 Hz power circuit, feeds power input leads 24 and 26, which may be neutral and hot, respectively. Lead 26 is connected directly to one side of load 11 and to capacitor 28; the latter serves as both an isolation and a voltage dropping component between the power source and control circuit power supply 16. Lead 24 is grounded as is triac 80 by means of which the connection of load 11 to the 110 volt power source is completed.

Capacitor 28 is also connected through Zener diode 30 of control circuit power supply 16 to ground. Zener diode 30 serves to clamp the voltage provided by capacitor 28 at a level which typically is less than 25 volts during the positive cycle of the input supply voltage. During the negative half of the cycle Zener diode 30 provides a short circuit. The resulting positive-pulsing DC voltage at the junction of capacitor 28 and Zener diode 30 is fed to the cathode of diode 34 and from the anode of diode 34 to storage capacitor 32. Storage capacitor 32 is made sufficiently large to produce a DC voltage which has a low ripple. This DC voltage is made available at the terminal marked +V for operating the low voltage circuitry of the switching system and is supplied to other parts of the circuit at terminals which are marked +V.

Power for operating remote switch units $SW_1$, $SW_2$. . . $SW_n$ is derived from power supply 16 via transistor 36. Two voltage levels are provided at the emitter connection of transistor 36, being connected via resistor 42 and connecting lead 20 to control circuit conductors 38 and 40. One side of each remote switch unit, $SW_1$, $SW_2$, . . . $SW_n$, is connected to conductor 38 and the other side is connected to ground via conductor 40.

Transistor 36 is an NPN transistor which is connected in an emitter-follower configuration and which responds to current flowing to the remote switches, via connecting lead 20 and resistor 42, to produce a control signal voltage. The control signal voltage is coupled, via connecting lead 26, to capacitor 43. When a switch unit such as $SW_1$ is actuated, the current flowing through transistor 36 and dropping resistor 42 via connecting line 20 is momentarily increased and a momentary drop in the voltage applied to the input of capacitor 43 results. The change appearing across the capacitor 43 is coupled by resistor 44 to the base of transistor 46.

Transistor 46 is connected in a Darlington configuration to transistor 48. A voltage +V from power supply 16, via resistor 50, holds the Darlington pair in conduction, maintaining the collectors of the transistors at a low potential. When a negative-going pulse, applied to the base of transistor 46 by capacitor 43, exceeds the positive potential provided by resistor 50, the Darlington pair is turned off and the potential at their collector rises towards +V, the potential supplied via collector load resistor 52. The resulting voltage rise is coupled through diode 54 to charge capacitor 58, which, together with parallel-connected resistor 56, forms a pulse stretching network across the output of the Darlington pair. The resulting stretched pulse is delivered via connecting lead 60 to the D input of clocked "D" latch 35.

Meanwhile, the presence of the momentary reduced voltage on line 20 has caused sensing capacitance 43 to charge to that voltage. Now the Darlington transistor pair 46,48 is returned to the quiescent conducting state by resistor 50, and the positive voltage on the Darlington collectors drops. Diode 54 is now back-biased by the resulting low voltage at its anode as compared to the more positive voltage which is present at its cathode due to the charge on capacitor 58. The charge stored in capacitor 58 now discharges through resistor 56, completing formation of the pulse supplied to the D terminal of "D" latch 35.

"D" latch 35 also has, as an input to its C (clock) terminal, a series of positive pulses derived via resistor 62 from the junction of coupling capacitor 28 with Zener diode 30 in power supply 16. "D" latch 35 is designed to transfer the voltage present at its D terminal to its Q terminal upon the application of a positive pulse to its C terminal at a time when the D terminal is high. This positive voltage is coupled on lead 64 to clock terminal C of "D" latch 66. Spurious noise pulses which could result in erroneous triggering of "D" latch 66 are reduced by means of capacitor 69 which is connected between line 64 and ground. "D" latch 66 is connected in bistable fashion so that a series of positive pulses fed to its C terminal produces alternately high and low potentials at its Q terminal. When the Q terminal of latch 66 is high, the $\overline{Q}$ terminal is low and vice versa.

The normally off condition of "D" latch 35 is with Q high, the "1" state, and $\overline{Q}$ low, or the "0" state. When $\overline{Q}$ of "D" latch 66 is low, it draws current from the collector of current source transistor 36 via resistor 68, reducing the voltage on the transistor's base and, due to emitter-follower action, reducing the voltage at the transistor's emitter. By properly proportioning resistor 68 relative to collector resistor 70, a reduction in voltage on line 20 to approximately half that of +V can be obtained. This reduced potential is such that, when a low impedance is impressed on line 20 by any switch unit SW, the change in voltage produced by the resulting voltage drop across resistor 42 will be sufficient to remove the forward bias theretofore applied to the Darlington transistor pair 46,48.

When the Q terminal of "D" latch 66 is in the high state, a "1" is coupled via lead 14 to resistor 72 at the input of a complementary astable multivibrator which is formed by transistors 74, 76 and their associated circuitry. This multivibrator controls the operation of triac 80. The frequency of operation of the multivibrator is established in the usual manner by capacitor 82 and resistor 84 which control the voltage on the base of transistor 74. Resistor 86 effectively biases transistor 74 off when the voltage on lead 14 is low. When the potential supplied on lead 14 is high, transistor 74 conducts and transistor 76 is made non-conducting by resistor 86 which holds the base and the emitter of transistor 76 at the same low potential relative to the collector. With transistor 76 off, both the gate and the main terminal of triac 80 are at the same potential, rendering the triac non-conducting and allowing no current to flow through load 11 and lead 26 to the source.

As previously stated, when any of the remote switches SW is activated, a relatively low impedance is connected between line 20 and ground and results in the production of a pulse in Darlington-connected transistors 46, 48, activating "D" latch 35 and applying a pulse to terminal C of "D" latch 66. This causes the Q terminal of this latch to go low and the $\overline{Q}$ terminal to go high. With the Q terminal low, forward bias is applied to the base of transistor 74 as a result of the voltage drop produced by current flow to the Q terminal through resistor 84, resistor 72, and lead 14. The bias on transistor 74 allows astable multivibrator 74, 76 to oscillate, producing a series of current pulses which are communicated to the gate terminal of triac 80 via resistor 78. Triac 80 then fires. The time constant of the astable multivibrator is such that the series of relatively narrow pulses recurs at a frequency which is many times that of source 12 and ensures repeated firings of triac 80 in all four quadrants of its turn-on characteristic, causing repeated current pulses to flow through load 11.

At the same time that the low signal is supplied to the astable multivibrator, "D" latch 66 transmits a high on lead 15 to emitter follower 36, causing the voltage level carried on line 20 to conductor pair 38, 40 to rise.

When any of the remote switches is next actuated, the process is reversed, with the Q terminal of "D" latch 66 going high. This has the effect of turning off the supply of pulses being fed to triac 80 from astable multivibrator 74,76 and thus turns off the flow of current to load 11. Now the potential supplied to remote switches $SW_1$, $SW_2 \ldots SW_n$, via line 20, is reduced to approximately one-half of the +V value by the return of the $\overline{Q}$ terminal of "D" latch 66 to its low condition, pulling down the voltage on the base of current source transistor 36 and lowering the voltage level on conductor pair 38, 40.

FIG. 3 is a schematic diagram of a remote switch SW which may be used in the above-described embodiment of the invention. Each switch SW comprises LED (light-emitting diode) 90, Zener diode 92, and current limiting resistor 94, the three being connected in series between conductors 38 and 40 (FIG. 2). Single-pole, normally-open switch 95 is connected between the junction of current limiting resistor 94 and Zener diode 92 and connecting line 40. Switch 95 is preferably a momentary closing switch; it can be a pushbutton. A second series circuit, consisting of another LED 96 and current limiting resistor 98, is also connected between control circuit leads 38 and 40. LED 96 serves as a power indicator and stays illuminated when the control circuit is energized, regardless of the operating voltage level which may appear on the conductor pair. LED 96 can also serve as a night light.

When the voltage level supplied to an actuator switch SW is approximately half that of +V, corresponding to the "off" state of triac 80, LED 90 is not illuminated because the voltage drop across Zener diode 92 is equal to that applied between control circuit conductors 38 and 40. When the potential appearing on line 38 is approximately +V, a condition which occurs when triac 80 is providing current to load 11, the voltage between control circuit conductors 38 and 40 is greater than the Zener potential of diode 92, and current flows through LED 90 at a level established by limiting resistor 94; the LED is illuminated and indicates that the load circuit is "on". When the voltage is less than +(V/2), LED 90 cannot light. Regardless of whether a switch unit SW is fed a full voltage or a half voltage, the closing of switch 95 places a low impedance between line 20 and ground and the load circuit is switched, going from the conducting mode to the non-conducting mode, or vice versa, and supplying current to the load, or not, depending upon the condition of the load switch circuit at the time switch 95 is closed.

It will be apparent to those skilled in the art that the number of switch units SW which may be connected between the control circuit conductors 38 and 40 is limited only by the capacity of the transistor chosen for use in current source 18; that the triac used to feed current to the load can be driven by a DC control circuit instead of the pulse circuit described above; that, given appropriate voltage levels, the voltage sensitive indicator could be a neon lamp; that a relay could be used in lieu of the triac and driven by a bistable latch of a different sort than that described above; or that a bistable (alternate action) relay could be substituted for the tirac and bistable latch, as depicted, for example, in FIG. 1A. Other substitutions for elements of the circuit will be apparent to those skilled in the art and can be used without departing from the spirit of the invention. The below appended claims should, therefore, be interpreted in keeping with the spirt of the invention rather than limited to the specific illustrative embodiments described above.

What is claimed is:

1. A switching device providing independent control of the connection of a load to a source of electric power from any one of a plurality of locations which are disposed along a control circuit while at the same time providing an indication at each of the locations of the state of the load connection, the switching device comprising:

load switch means for connecting the load to the source of electric power, the load switch means having an input for a load control signal, the load switch means being responsive to successive load control signals to connect and to disconnect the load and the source of electric power;

control switch means adapted to be connected to the control circuit at each different location of the plurality of locations, each control switch means being adapted to normally present a first impedance to the control circuit and when actuated to momentarily present a second impedance to the control circuit;

means adapted to be connected to the load switch means and to the control circuit for generating a load control signal for the input of the load switch means and for generating an indicator signal for the control circuit, the signal generating means being adapted to generate the load control signal and the corresponding indicator signal in response to the presence of the second impedance on the control circuit; and indicator means adapted to be disposed at each different location of the plurality of locations, each indicator means being adapted to be connected to the control circuit and to respond to an indicator signal thereon to indicate the state of the load connection.

2. The switching device of claim 1 in which the indicator signal comprises first and secnd voltage levels and in which the indicator means is voltage sensitive and responds to only one of the voltage levels to indicate the state of the load connection.

3. The switching device of claim 1 in which:

the means for generating the load control signal and the indicator signal comprises a current supply, the current supply providing an indicator signal comprising first and second voltage levels, the first voltage level being present when the load is connected to the power source and the second level being present when the load is disconnected; and the indicator means responds to one of the voltage levels and does not respond to the other voltage level.

4. The switching device of claim 1 in which:

the load switch means further comprises means for generating a signal which indicates the state of the load connection; and the means for generating the the load control signal and the indicator signal comprises a current supply which responds to the state of the load connection signal to provide first and second voltage levels to the control circuit.

5. The switching device of claim 4 in which:

the load switch means further comprises means for generating a state of the load connection signal;

the state of the load connection signal comprises a first voltage level when the load is connected to the power source and a second voltage level when the load is disconnected from the power source; and the current supply comprises a transistor connected as an emitter follower, the emitter follower responding to the first voltage level of the state of the load connection signal to generate one voltage level of the load control signal and to the second level of the state of the load connection signal voltage to generate the other voltage level of the load control signal.

6. The switching device of claim 2 in which the indicator means comprises a volage sensitive light emitter which is connected in series with a current limiting device.

7. The switch device of claim 2 in which the voltage sensitive indicator means comprises a light emitting diode which is connected in series with a Zener diode and a current limiting device.

8. The switching device of claim 6 in which the control switch means further comprises a momentary closing switch which is connected across the voltage sensitive light emitter.

9. The switching device of claim 7 in which the control switch means further comprises a momentary closing switch which is connected across the light emitting diode and the Zener diode.

10. The switching device of claim 2 and further comprising:

second indicator means adapted to be connected to the control circuit, the second indicator means adapted to respond to either voltage level on the control circuit to indicate that the control circuit is energized.

11. The switching device of claim 1 in which the load switch means comprises an alternate action relay.

12. A method of independently controlling the connection of a load to a source of electric power from any one of a plurality of locations which are disposed along a control circuit while at the same time providing an indication at each of the locations of the state of the load connection, the method comprising the steps of:

connecting the load to the source of electric power by load switch means having an input for a load control signal, the load switch means being responsive to successive load control signals to connect and to disconnect the load and the source of electric power;

connecting control switch means to the control circuit at each different location of the plurality of locations, each control switch means being adapted to normally present a first impedance to the control circuit and when actuated to momentarily present a second impedance to the control circuit;

generating a load control signal for the input of the load switch means and generating an indicator signal for the control circuit, in response to the presence of the second impedance on the control circuit; and indicating the state of the load connection at each different location of the plurality of locations in response to the indicator signal on the control circuit.

13. The method of claim 12 in which the step of generating an indicator signal comprises generating first and second voltage levels and in which the step of indicating the state of the load connection comprises responding to only one of the voltage levels to indicate the state of the load connection.

* * * * *